US007418949B2

(12) United States Patent
Boecking

(10) Patent No.: US 7,418,949 B2
(45) Date of Patent: Sep. 2, 2008

(54) COMMON RAIL INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/630,282

(22) PCT Filed: May 11, 2005

(86) PCT No.: PCT/EP2005/052145

§ 371 (c)(1),
(2), (4) Date: Dec. 20, 2006

(87) PCT Pub. No.: WO2006/003048

PCT Pub. Date: Jan. 12, 2006

(65) Prior Publication Data

US 2008/0029067 A1 Feb. 7, 2008

(30) Foreign Application Priority Data

Jul. 1, 2004 (DE) ..... 10 2004 031 790

(51) Int. Cl.
*F02M 37/04* (2006.01)
*F02M 37/08* (2006.01)

(52) U.S. Cl. ..... 123/498; 239/102.2

(58) Field of Classification Search ..... 123/498, 123/472, 478, 490, 102.2, 533.3, 584, 585.1
See application file for complete search history.

(56) References Cited

U.S. PATENT DOCUMENTS

| | | | | |
|---|---|---|---|---|
| 6,279,840 | B1 | 8/2001 | Buckley | |
| 6,478,013 | B1 * | 11/2002 | Boecking | 123/467 |
| 6,575,385 | B1 * | 6/2003 | Stier | 239/102.2 |
| 6,857,585 | B2 * | 2/2005 | Winner | 239/533.2 |
| 7,258,109 | B2 * | 8/2007 | Mennicken | 123/479 |
| 2002/0014540 | A1 | 2/2002 | Cooke | |
| 2003/0155439 | A1 * | 8/2003 | Winner | 239/533.2 |
| 2004/0154562 | A1 * | 8/2004 | Mattes et al. | 123/90.11 |
| 2004/0173694 | A1 | 9/2004 | Cooke | |
| 2005/0205686 | A1 * | 9/2005 | Yildirim et al. | 239/102.2 |
| 2006/0022554 | A1 * | 2/2006 | Mennicken | 310/316.03 |

FOREIGN PATENT DOCUMENTS

| | | |
|---|---|---|
| DE | 101 59 749 A1 | 6/2003 |
| DE | 102 13 858 A1 | 10/2003 |
| DE | 102 30 089 A1 | 1/2004 |
| EP | 1 111 230 A2 | 6/2001 |

(Continued)

*Primary Examiner*—Mahmoud Gimie
(74) *Attorney, Agent, or Firm*—Ronald E. Greigg

(57) ABSTRACT

A common rail injector having an injector housing with a fuel inlet connected to a central high-pressure fuel source outside the injector housing and to a pressure chamber inside the injector housing from which pressure chamber depending on the pressure in a control chamber fuel is injected when a nozzle needle lifts away from its seat and in which the pressure in the control chamber is controlled in a direct, inverse fashion by an actuator in particular a piezoelectric actuator. The combustion chamber end of the actuator or an actuator head provided on the actuator is guided in actuator guide section of a coupler sleeve, which has a larger inner diameter than a nozzle needle guide section of the coupler sleeve in which the end of the nozzle needle oriented away from the combustion chamber is guided.

12 Claims, 1 Drawing Sheet

FOREIGN PATENT DOCUMENTS

| | | | |
|---|---|---|---|
| EP | 1 174 615 | A2 | 1/2002 |
| EP | 1 382 838 | A2 | 1/2004 |
| JP | 10-288120 | | 10/1998 |
| JP | 2004-19564 | | 1/2004 |
| WO | WO 94/19597 | A1 | 9/1994 |
| WO | WO 03/081020 | A1 | 10/2003 |
| WO | WO 2005/014995 | A1 | 2/2005 |
| WO | WO 2005/068821 | A1 | 7/2005 |

* cited by examiner

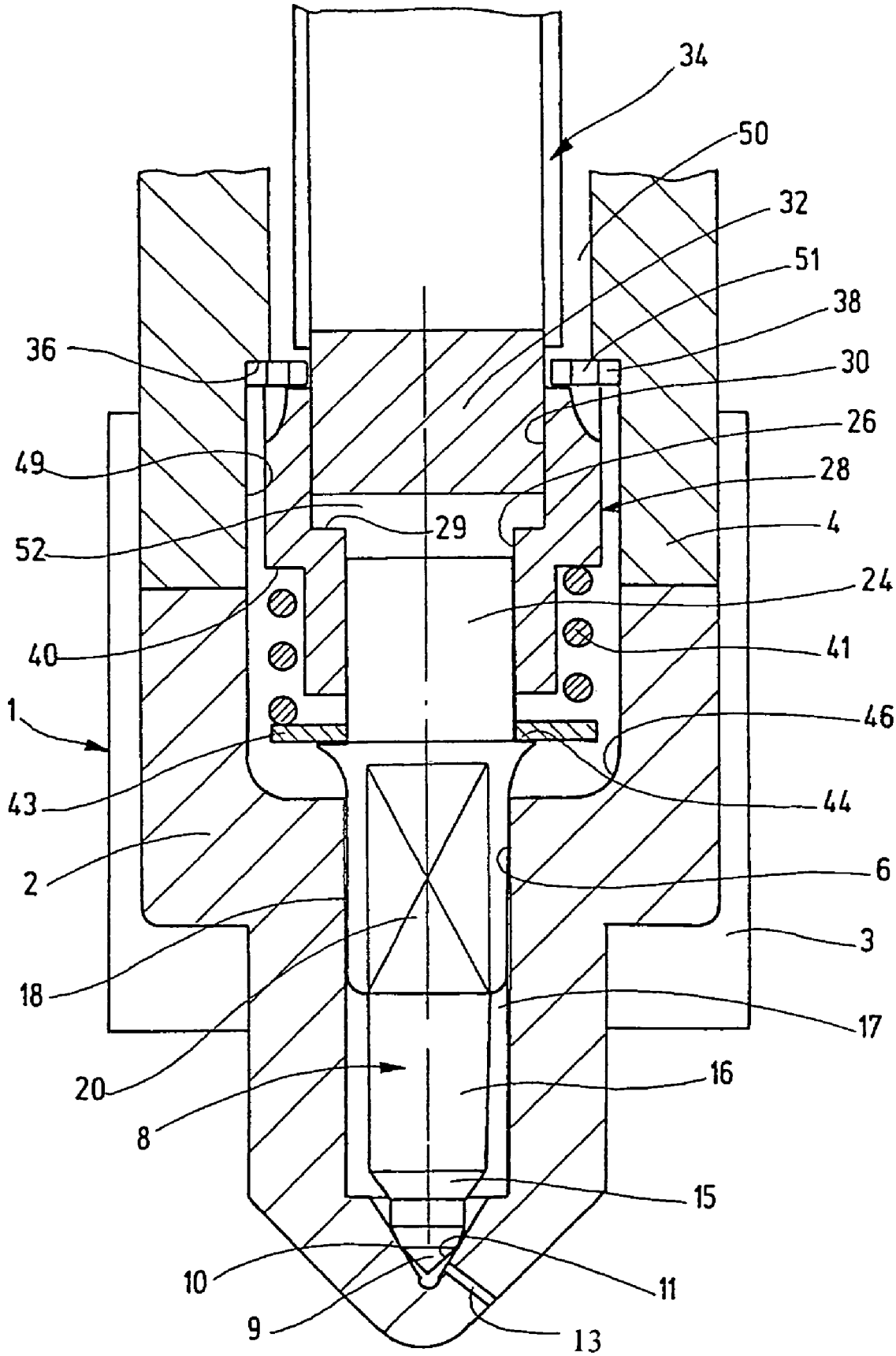
34
50
32
51
38
36
30
26
49
28
29
4
52
24
40
41
1
46
43
44
2
6
3
18
17
20
16
8
15
10
11
9
13

COMMON RAIL INJECTOR

CROSS-REFERENCE TO RELATED APPLICATION

This application is a 35 USC 371 application of PCT/EP 2005/052145 filed on May 11, 2005.

BACKGROUND OF THE INVENTION

The invention relates to a common rail injector, which has an injector housing equipped with a fuel inlet that is connected to a central high-pressure fuel source outside the injector housing and, inside the injector housing, is connected to a pressure chamber from which, depending on the pressure in a control chamber, highly pressurized fuel is injected into a combustion chamber of an internal combustion engine when a nozzle needle lifts away from its seat, and in which the pressure in the control chamber is controlled in a direct, inverse fashion by an actuator, in particular a piezoelectric actuator.

FIELD OF THE INVENTION

The invention is based on a fuel injection system for an internal combustion engine.

If the pressure in the control chamber of a common rail injector is controlled by an actuator, in particular a piezoelectric actuator, then this is also referred to as a direct nozzle needle control. Inverse control refers to the control of an injector in which the actuator is supplied with current in the neutral position and is switched into a currentless state in order to open the nozzle. In the currentless state, the volume of the actuator decreases so that the pressure in the control chamber drops and the nozzle needle lifts away from its seat. When the actuator is supplied with current again, then the nozzle needle closes. Conventional common rail injectors with direct, inverse control of the nozzle needle are complex in design and require a relatively large amount of space.

The object of the present invention is to create a simply designed and inexpensive-to-manufacture compact common rail injector, which has an injector housing equipped with a fuel inlet that is connected to a central high-pressure fuel source outside the injector housing and, inside the injector housing, is connected to a pressure chamber from which, depending on the pressure in a control chamber, highly pressurized fuel is injected into a combustion chamber of an internal combustion engine when a nozzle needle lifts away from its seat, and in which the pressure in the control chamber is controlled in a direct, inverse fashion by an actuator, in particular a piezoelectric actuator.

SUMMARY OF THE INVENTION

In a common rail injector, which has an injector housing equipped with a fuel inlet that is connected to a central high-pressure fuel source outside the injector housing and, inside the injector housing, is connected to a pressure chamber from which, depending on the pressure in a control chamber, highly pressurized fuel is injected into a combustion chamber of an internal combustion engine when a nozzle needle lifts away from its seat, and in which the pressure in the control chamber is controlled in a direct, inverse fashion by an actuator, in particular a piezoelectric actuator, the above object is attained in that the combustion chamber end of the actuator or an actuator head provided on the actuator is guided in an actuator guide section of a coupler sleeve, which has a larger inner diameter than a nozzle needle guide section of the coupler sleeve in which the end of the nozzle needle oriented away from the combustion chamber is guided. In the context of the present invention, a direct control of the pressure in the control chamber is understood to mean the achievement of a pressure decrease and/or pressure increase in the control chamber as a result of a deformation or volume change of the actuator. The present invention's combination of a control chamber delimiting sleeve with a coupler achieves a compact design without additional components such as shims. The dimensions of the inner diameters of the nozzle needle guide section and the actuator guide section are selected so that only a relatively slight expansion of the actuator is required in order to trigger the nozzle needle movement. This offers the advantage of permitting relatively short actuators to be used.

A preferred exemplary embodiment of the injector is characterized in that the nozzle needle is guided only in a nozzle body. Thanks to the simple design of the injector according to the present invention, no additional guidance of the nozzle needle is required in the injector housing.

Another preferred exemplary embodiment of the injector is characterized in that the end of the coupler sleeve oriented away from the combustion chamber is supported against the injector housing in the axial direction. This prevents the coupler sleeve from moving away from the combustion chamber in the injector housing. The support against the injector housing is preferably designed so that the coupler sleeve is able to move toward the combustion chamber. This simplifies assembly.

Another preferred exemplary embodiment of the injector is characterized in that the nozzle body, for example with the aid of a retaining nut, is clamped against an injector body, which has an actuator receptacle in which a shoulder is provided, against which the coupler sleeve is supported. The shoulder constitutes a stop for the coupler sleeve in the axial direction.

Another preferred exemplary embodiment of the injector is characterized in that the end of the coupler sleeve oriented away from the combustion chamber is supported against a retaining disk that is in turn supported against the shoulder of the injector body. This creates a stop for the coupler sleeve in a simple way.

Another preferred exemplary embodiment of the injector is characterized in that the retaining disk is contained in an annular chamber, which is situated between the injector body and the actuator and constitutes the fuel inlet; the retaining disk has at least one opening extending through it in the axial direction. The through opening permits highly pressurized fuel supplied from the high-pressure fuel source to pass through.

Another preferred exemplary embodiment of the injector is characterized in that a spring device clamps the coupler sleeve against the injector housing in the axial direction. In the neutral position of the injector, i.e. when no injection is occurring, the spring device serves in particular to position the coupler sleeve against the shoulder of the actuator receptacle.

Another preferred exemplary embodiment of the injector is characterized in that the end of the spring device oriented toward the combustion chamber is supported against the nozzle needle. The spring device has two functions. On the one hand, it serves to position the coupler sleeve. On the other hand, the spring device functions as a nozzle spring that presses the nozzle needle against its seat in the neutral position of the injector.

Another preferred exemplary embodiment of the injector is characterized in that the end of the spring device oriented toward the combustion chamber is supported against a spring plate, which in turn is supported against a shoulder provided on the nozzle needle. This creates an easy-to-install engagement surface for the spring device on the nozzle needle.

Another preferred exemplary embodiment of the injector is characterized in that the actuator and the coupler sleeve are subjected to high pressure. The actuator and the coupler sleeve float in the common rail pressure, which is supplied from the high-pressure fuel source via the fuel inlet.

BRIEF DESCRIPTION OF THE DRAWING

Other advantages, defining characteristics, and details of the present invention ensue from the description below in which an exemplary embodiment is described in detail in conjunction with the single drawing figure showing a longitudinal section through an exemplary embodiment of a common rail injector according to the present invention.

DESCRIPTION OF THE PREFERRED EMBODIMENT

The common rail injector shown in the drawing includes an injector housing 1 having a nozzle body 2 whose lower, freely extending end protrudes into the combustion chamber of the engine to be fed. The upper end surface of the nozzle body 2 oriented away from the combustion chamber is clamped axially to an injector body 4 by means of a retaining nut 3.

The nozzle body 2 has an axial guide bore 6 let into it. A nozzle needle 8 is guided in sliding fashion in the guide bore 6. The tip 9 of the nozzle needle 8 is provided with a sealing edge 10, which cooperates with a sealing seat or sealing surface 11 provided on the nozzle body 2. When the sealing edge 10 of the tip 9 of the nozzle needle 8 rests against the sealing seat 11, this closes an injection port 13 in the nozzle body 2. When the sealing edge 10 of the nozzle needle tip 9 lifts away from its sealing seat 11, then highly pressurized fuel is injected from the injector housing 1 through the injection port 13 or a plurality of injection ports into the combustion chamber of the engine.

Starting from the tip 9, the nozzle needle 8 has a section 15 that widens out in truncated cone fashion, which is followed by a pressure chamber section 16 embodied essentially in the form of a circular cylinder. The sections 15 and 16 of the nozzle needle 8 are contained in a pressure chamber 17 inside the nozzle body 2. The pressure chamber section 16 is followed by a guide section 18 that guides the nozzle needle 8 in the axial guide bore 6 in the nozzle body 2. In the region of the guide section 18, the nozzle needle 8 is provided with at least one flattened region 20 via which the pressure chamber 17 is supplied with highly pressurized fuel.

The end of the nozzle needle 8 oriented away from the combustion chamber is embodied in the form of a circular cylinder that is guided in a sealed fashion in a nozzle needle guide section 26 of a coupler sleeve 28. The end of the nozzle needle guide section 26 oriented away from the combustion chamber is provided with a step in the radially outward direction, starting from which an actuator guide section 30 extends away from the combustion chamber. The actuator guide section 30 has a larger inner diameter than the nozzle needle guide section 26. The end 32 of an actuator 34 oriented toward the combustion chamber is guided in a sealed fashion in the actuator guide section 30. The actuator 34 is a piezoelectric actuator, which has a greater length or greater volume in the longitudinal direction when supplied with current than it does in the currentless state.

The coupler sleeve 28, which is also referred to as the coupling sleeve, at its end oriented away from the combustion chamber, is supported in the axial direction against a retaining disk 38, whose design essentially corresponds to that of a circular washer with a rectangular cross-section. The retaining disk 38 is supported along its radially outer edge against a shoulder 36 provided in the injector body 4. The shoulder 36 divides an axial section of the injector body 4 oriented toward the combustion chamber from an axial section of the injector body 4 oriented away from the combustion chamber, which has a smaller inner diameter than the section oriented toward the combustion chamber.

On its radially outer surface, the coupler sleeve 28 is provided with a shoulder 40 that divides an axial section of the coupler sleeve 28 oriented away from the combustion chamber from an axial section oriented toward the combustion chamber, which has a smaller outer diameter than the section oriented away from the combustion chamber. The end of a prestressed helical compression spring 41 oriented away from the combustion chamber rests against the shoulder 40, while its end oriented toward the combustion chamber rests against a spring plate 43. The helical compression spring 41 is thus clamped between the shoulder 40 of the coupler sleeve 28 and the spring plate 43, which is supported in the axial direction against a collar 44 of the nozzle needle 8. The collar 44 is situated in the axial direction between the flattened region 20 and the end 24 of the nozzle needle 8 oriented away from the combustion chamber.

The end 24 of the nozzle needle 8 oriented away from the combustion chamber protrudes into a central receptacle 46, which is provided at the end of the nozzle body 2 oriented away from the combustion chamber and has a larger inner diameter than the axial guide bore 6. The central receptacle 46 transitions into an actuator receptacle 49, which is provided at the end of the injector body 4 oriented toward the combustion chamber and has the same inner diameter as the central receptacle 46. The cavity comprised of the central receptacle 46 and the actuator receptacle 49 contains the collar 44, the spring plate 43, the helical compression spring 41, the coupler sleeve 28, the end 24 of the nozzle needle 8 oriented away from the combustion chamber and the end 32 of the actuator 34 oriented toward the combustion chamber.

The actuator receptacle 49 is fed by a fuel inlet 50, which is embodied essentially in the form of an annular space situated between the actuator 34 and the injector body 4. Via a connecting line (not shown), the fuel inlet 50 communicates with a central high-pressure fuel source outside of the injector housing 1. From the fuel inlet 50, highly pressurized fuel travels into the actuator receptacle 49 and the central receptacle 46 via at least one through opening 51 that is provided in the retaining disk 38. From the central receptacle 46, the highly pressurized fuel flows past the flattened region 20 into the pressure chamber 17.

Between the end surface of the actuator 34 oriented toward the combustion chamber and the end surface of the nozzle needle 8 oriented away from the combustion chamber, a control chamber 52 is delimited inside the coupler sleeve 28; the pressure in this control chamber 52 is used to control the opening and closing of the nozzle needle 8. The actuator 34 is supplied with current in the neutral state, i.e. when no injection is occurring because the sealing edge 19 of the tip 9 of the nozzle needle 8 is resting against the sealing seat 11. When supplied with current, the end 32 of the actuator 34 displaces a larger volume in the control chamber 52 than when it is not supplied with current.

When the supply of current to the actuator 34 is interrupted, then the piezoelectric effect or reverse piezoelectric effect causes the end 32 of the piezoelectric actuator 34 to retract, i.e. to move away from the combustion chamber. As a result, the volume of the control chamber 52 increases, thus decreasing the pressure in control chamber 52. The pressure difference in control chamber 52 between the powered and currentless states of the actuator 34 causes the nozzle needle 8, in response to the high pressure prevailing in the pressure chamber 17, to lift its tip 9 and sealing edge 10 away from the associated sealing seat 11 so that fuel is injected from the pressure chamber 17 through the injection port 13 into the combustion chamber of the engine to be fed.

When the actuator 34 is once again supplied with current, then the end 32 of the actuator 34 expands into the control chamber 52 so that the pressure in the control chamber 52 correspondingly increases. In conjunction with this, the prestressing force of the helical compression spring 41, which can also be referred to as the nozzle spring, causes the nozzle needle 8 to close by moving the sealing edge 10 of the tip 9 of the nozzle needle 8 into contact with the sealing seat 11.

The foregoing relates to a preferred exemplary embodiment of the invention, it being understood that other variants and embodiments thereof are possible within the spirit and scope of the invention, the latter being defined by the appended claims.

The invention claimed is:

1. A common rail injector comprising an injector housing, a control chamber, a nozzle needle, a fuel inlet connected to a central high-pressure fuel source outside the injector housing and to a pressure chamber inside the injector housing, from which pressure chamber, depending on the pressure in the control chamber, highly pressurized fuel is injected into a combustion chamber of an internal combustion engine upon the nozzle needle lifting away from a sealing seat, a piezoelectric actuator controlling the pressure in the control chamber in a direct, inverse fashion, and a coupler sleeve having a nozzle needle guide section and an actuator guide section, an end of the actuator disposed toward the combustion chamber being guided in an actuator guide section end of the coupler sleeve, an end of the nozzle needle oriented away from the combustion chamber being guided in a nozzle needle guide section end of the coupler sleeve, wherein an inner diameter of the actuator guide section end is larger than an inner diameter of the nozzle needle guide section end, wherein the actuator guide section end is supported in an axial direction against a shoulder of the injector housing, and wherein the injector housing is embodied by a nozzle body disposed on an injector body, the nozzle body encompassing the nozzle needle and guiding the nozzle needle therein and the injector body encompassing the actuator.

2. The injector according to claim 1, further comprising a retaining nut clamping the nozzle body against an injector body, the injector body having an actuator receptacle in which the shoulder is provided, against which the coupler sleeve is supported.

3. The injector according to claim 2, further comprising a retaining disk supporting the actuator guide section end of the coupler sleeve oriented away from the combustion chamber, the retaining disk in turn being supported against the shoulder of the injector body.

4. The injector according to claim 3, further comprising an annular chamber situated between the injector body and the actuator, the annular chamber constituting the fuel inlet, wherein the retaining disk is disposed in the annular chamber and has at least one opening extending therethrough in the axial direction through which the fuel flows.

5. The injector according to claim 1, further comprising a spring device clamping the coupler sleeve against the injector housing in the axial direction.

6. The injector according to claim 2, further comprising a spring device clamping the coupler sleeve against the injector housing in the axial direction.

7. The injector according to claim 3, further comprising a spring device clamping the coupler sleeve against the injector housing in the axial direction.

8. The injector according to claim 4, further comprising a spring device clamping the coupler sleeve against the injector housing in the axial direction.

9. The injector according to claim 5, wherein the end of the spring device oriented toward the combustion chamber is supported against the nozzle needle.

10. The injector according to claim 9, wherein the end of the spring device oriented toward the combustion chamber is supported against a spring plate, which in turn is supported against a shoulder provided on the nozzle needle.

11. The injector according to claim 1, wherein the actuator and the coupler sleeve are subjected to high pressure.

12. The injector according to claim 2, wherein the actuator and the coupler sleeve are subjected to high pressure.

* * * * *